US005093678A

United States Patent [19]

Muller et al.

[11] Patent Number: 5,093,678

[45] Date of Patent: Mar. 3, 1992

[54] PROCESSOR WITH LAMINAR FLUID FLOW WICK

[75] Inventors: Bruce R. Muller, Rochester; Douglas O. Hall, Canandaiqua, both of N.Y.

[73] Assignee: Eastman Kodak Company, Rochester, N.Y.

[21] Appl. No.: 628,052

[22] Filed: Dec. 17, 1990

[51] Int. Cl.[5] ..... G03D 3/06

[52] U.S. Cl. ..... 354/324; 354/322

[58] Field of Search ..... 354/320, 321, 322, 324, 354/325

[56] References Cited

U.S. PATENT DOCUMENTS

| | | | |
|---|---|---|---|
| 3,645,298 | 2/1972 | Roberts et al. | 138/40 |
| 3,945,402 | 3/1976 | Murphy | 138/37 |
| 3,946,039 | 3/1976 | Walz | 264/332 |
| 4,043,360 | 8/1977 | Yaron | 138/42 |
| 4,398,818 | 8/1983 | Jeromin et al. | 354/324 X |
| 4,505,877 | 3/1985 | Rion | 376/352 |
| 4,576,204 | 3/1986 | Smallhorn | 138/44 |
| 4,660,587 | 4/1987 | Rizzie | 137/8 |
| 4,716,936 | 1/1988 | Mon et al. | 137/833 |
| 4,989,028 | 1/1991 | Hall et al. | 354/324 |
| 4,994,840 | 2/1991 | Hall et al. | 354/324 |

*Primary Examiner*—A. A. Mathews

*Attorney, Agent, or Firm*—G. Herman Childress

[57] ABSTRACT

A processor for photosensitive material provides a processing solution to a processing chamber while the photosensitive material is advanced through the chamber. The processing solution is drained from the chamber and passes through a chute as it is returned to a sump for recirculation to the processing chamber. A laminar fluid flow wick located in the chute avoids air entrapment that would be caused by fluid freely flowing through the chute.

2 Claims, 3 Drawing Sheets

PROCESSOR WITH LAMINAR FLUID FLOW WICK

CROSS-REFERENCE TO A RELATED APPLICATION

Reference is made to commonly-assigned, copending U.S. patent application Ser. No. 07/495,671, entitled "Apparatus for Processing Photosensitive Material", filed Mar. 16, 1990 in the names of D. O. Hall and B. R. Muller, now U.S. Pat. No. 4,994,840.

BACKGROUND OF THE INVENTION

This invention relates to apparatus for processing photosensitive material, such as sheets of X-ray film, wherein a processing fluid is returned to a sump in a way which avoids entrapment of air in the fluid returning to the sump.

The processing apparatus described in the before-mentioned copending U.S. patent application includes an upper tank and a lower tank for holding a processing fluid. The tanks are located on opposite sides of a processing device, and fluid can flow from the tanks into a narrow processing chamber through which a sheet of photosensitive material is advanced for processing of latent images on the material. The processing fluid then travels through drains to chutes where the fluid flows downwardly and is returned to a sump for recirculation to the processing chamber.

It is known that aeration and air entrapment can cause degradation of the chemistry of a processing solution. Thus, it is desirable to reduce or eliminate the aeration or entrapment of air in such solutions. Air entrapment occurs any time the processing solution experiences a free-fall condition. In the apparatus disclosed in the before-mentioned application, aeration and air entrapment can occur when the processing solution is returned from the processing chamber to the sump because the processing solution experiences a free-fall situation as it flows through the drains and chute in the process of being returned to the sump. Accordingly, it is desirable to eliminate the free-fall condition existing in the apparatus of the before-mentioned copending U.S. patent application and to obtain, instead, a laminar flow of the processing fluid as it is returned to the sump.

SUMMARY OF THE INVENTION

Accordingly, it is an object of the invention to reduce aeration and air entrapment that can cause degradation of the chemistry of a processing solution. Another object of the invention is to provide laminar flow of a processing solution as it is returned to the sump from a processing chamber of a processor of the kind disclosed is the before-mentioned copending patent application.

The present invention relates to an improvement in a processor for processing latent images on a photosensitive material. The processor has a processing chamber through which the material can be advanced, and a sump for holding a supply of processing fluid. Means are provided for supplying processing fluid along a path extending from the sump to the chamber and back to the sump. At least one part of the path is located so that the processing fluid flows downwardly in the one part of the path. The improvement includes means located along the one part of the path to avoid free-fall of the fluid in the one part of the path and to produce laminar flow of the fluid, thereby reducing entrapment of air in the fluid.

The invention, and its objects and advantages, will become more apparent in the detailed description of the preferred embodiment present below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

In the following description, portions of the apparatus which are the same or similar to the processing apparatus of the before-mentioned U.S. application Ser. No. 495,671 will be described initially, followed by a description of the improvements of the present invention.

Figure 1:
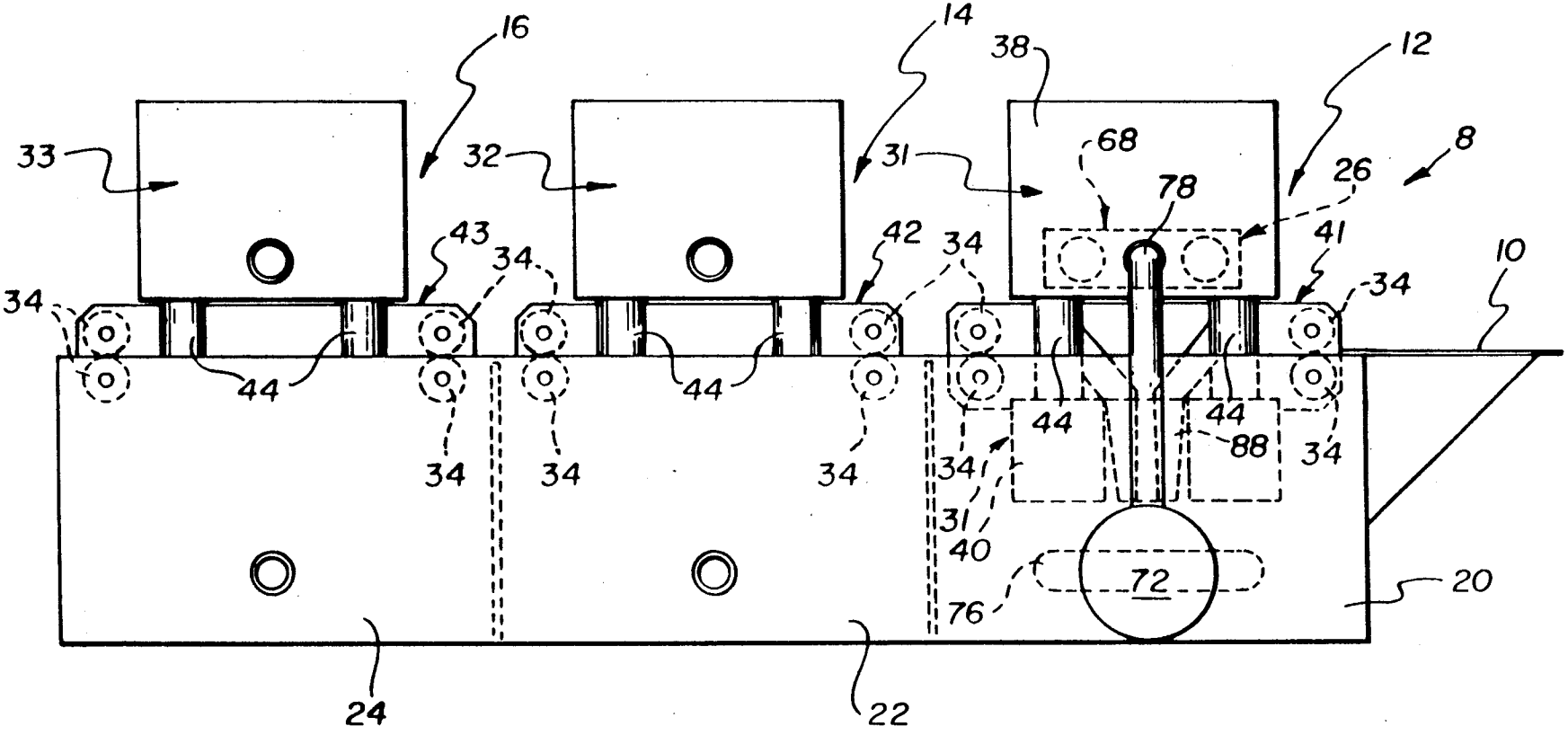
FIG. 1 is a side view of a photographic processing apparatus in accordance with the invention.
Figure 2:
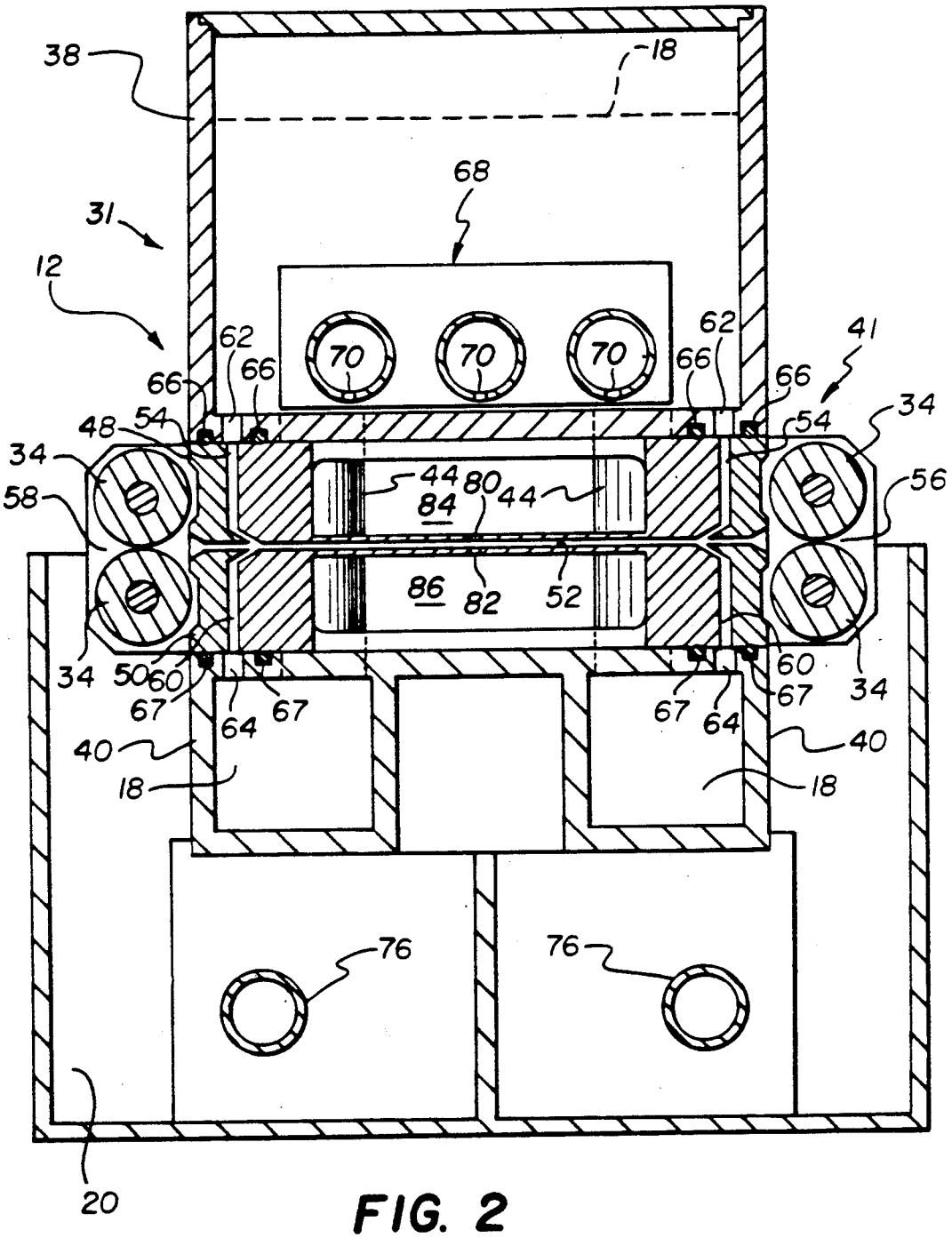
FIG. 2 is a cross-section through one of the units of the processing apparatus.

FIGS. 1 and 2 of the drawings illustrate a photographic processing apparatus of the invention, generally designated 8, that is useful for processing a strip or sheet of photosensitive material 10 (film or paper). The photographic processing apparatus includes a plurality of photographic processing units, three of which are shown at 12, 14 and 16. A processing fluid 18 (FIG. 2) is supplied to each unit. The fluid 18 is generally in a liquid form including such photographic processing liquids as developer, fixer, bleach, rinsing fluid, water or any other fluids for use in the processing of photosensitive materials. Any number of photographic processing units can be included in the photographic processing apparatus depending on the number of processing fluids required for processing a specific photosensitive material.

A plurality of sump tanks 20, 22, 24 for fluid 18 are provided for units 12, 14, 16, respectively. The units 12, 14, 16 include vessels 31, 32, 33 respectively and processing devices 41, 42, 43, respectively.

The film 10 is conveyed through the apparatus by a plurality of pairs of nip rollers 34 of the photographic processing units 12, 14, 16. The rollers can be driven by any conventional drive means (not shown).

The photographic processing units 14, 16 are the same or similar in construction to the photographic processing unit 12. Therefore only processing unit 12 will be described in detail. Referring now to FIG. 2, vessel 31 comprises an upper tank 38 and a lower tank 40. Four connecting tubes 44 connect the interior of tanks 38 and 40. The tubes allow the fluid 18 to flow freely between the upper tank 38 and the lower tank 40.

A processing device 41 is located between the upper tank 38 and the lower tank 40. The device 41 includes a first or upper applicator housing 48 and a second or lower applicator housing 50. The housings define a fluid chamber 52, and film 10 travels through the chamber during processing of the film 10. Fluid 18 enters the chamber 52 through two elongated slots 54 in housing 48. The slots are located proximate an entrance end 56 and an exit end 58, respectively, of the fluid chamber 52.

The fluid 18 also enters the chamber 52 through two elongated slots 60 in housing 50. The slots are located near the entrance and exit ends 56, 58 respectively of the fluid chamber 52. Thus an upper layer of fluid 18 and a lower layer of fluid 18 are formed on opposite sides of the film 10 in chamber 52.

The upper tank 38 has slits 62 in the lower wall which are aligned with the inlet slots 54 in housing 48. Also, the lower tank 40 has slits 64 formed in its upper wall which are aligned with the inlet slots 60 in housing 50. The slits 62 permit fluid 18 to flow between the upper tank 38 and the chamber 52, and the slit 64 allows fluid to flow between the lower tank 40 and the chamber 52. Accordingly, the processing device 41 is essentially submersed in the fluid 18 in the vessel 31. O-rings 66,67 seal the interface between the tanks 38, 40 and the applicator housings 48 and 50.

Fluid is supplied to upper tank 38 through a conduit 68 having openings 78 therein. A pump 72 has an inlet connected to a conduit 76 in sump 20. Conduit 76 also has openings therein (not shown) which enables the pump to withdraw fluid from the sump through conduit 76. The pump has an outlet connected by a conduit 78 to conduit 68 in the upper tank. Thus, operation of pump 72 effects circulation (and recirculation) of fluid from sump 20 to the upper tank 38.

Processing fluid furnished to chamber 52 flows toward the center of the processing device 41 and along both surfaces of the photosensitive material 10. Fluid is exhausted from chamber 52 through slit-like orifices 80, 82 that lead into upper and lower drains 84, 86, respectively. The processing fluid flows from drains 84, 86 through chutes 88, 90, respectively, and then back into the sump 20, as shown in FIG. 3.

Figure 3:
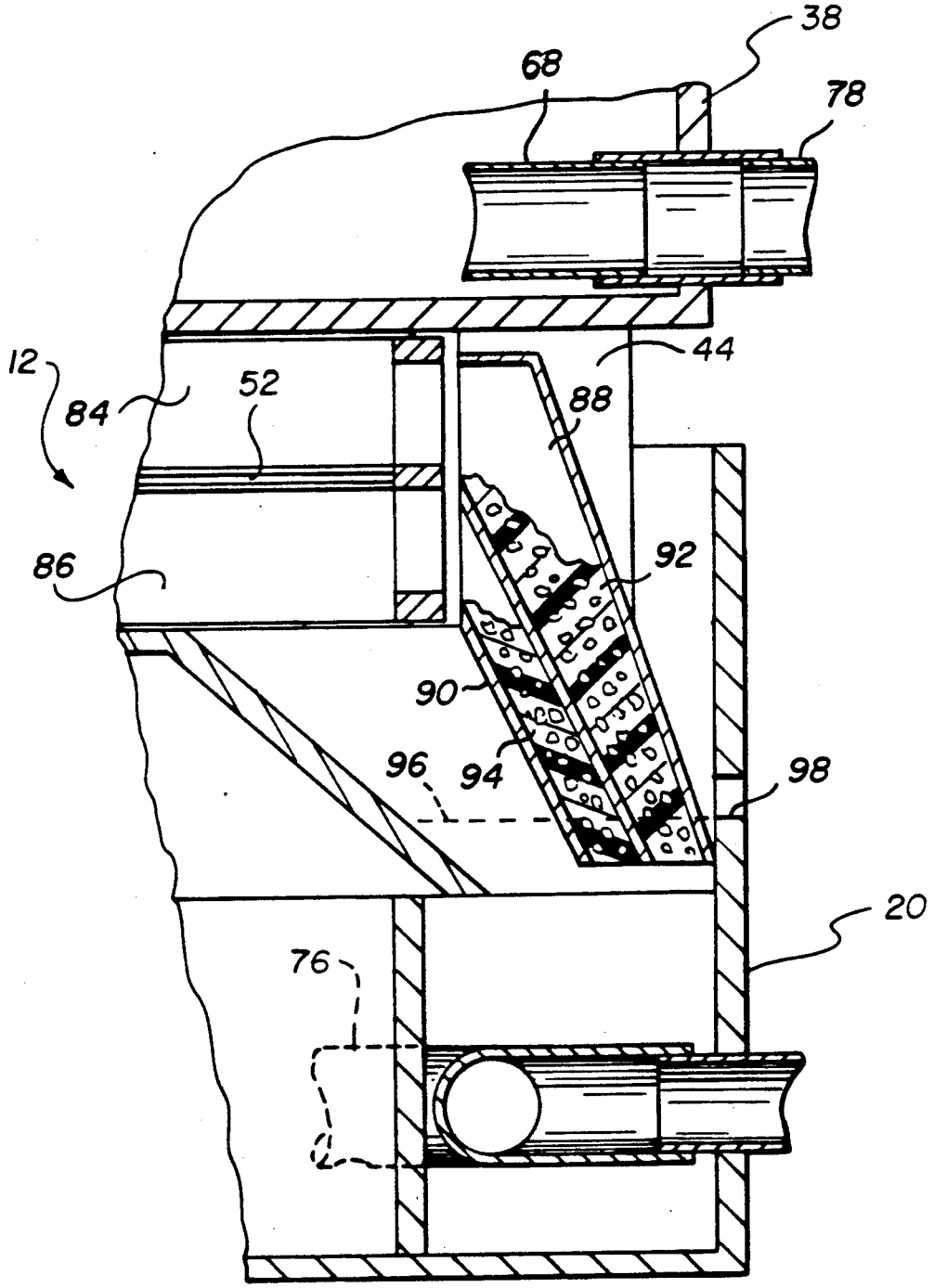
FIG. 3 is a fragmentary section showing the path for processing solutions from the processing chamber to the sump and illustrating therein a wick for producing a laminar flow of the fluid.

As will be observed from FIG. 3, the chutes 88, 90 extend in a generally vertical direction which allows the processing fluid to encounter a free-flow condition as it leaves the drains and falls through the chute on the way to the sump as disclosed in the before-mentioned U.S. patent application Ser. No. 495,671. As noted hereinbefore, when processing fluid encounters such a free-flow of condition, aeration and air entrapment occurs in the fluid, thereby degrading the chemistry of the fluid.

In accordance with the present invention, the free-flow condition of the fluid from the drains 84, 86 to the sump tank is eliminated, thus, avoiding air entrapment and the resulting detrimental effect to the chemistry of the processing fluid. More specifically, in accordance with the present invention, wicks 92, 94 are provided in the chutes 88, 90, respectively to produce a laminar flow of the fluid as it travels from the drains into the sump tank. The wicks are formed of a flexible material and extend from the outlet of the drains 84, 86 along the chutes in a downwardly direction from the drains. The wicks are made from a material which is chemically inert to the fluid traveling through the wicks. By way of example, the wicks can be made from an open cell foam material, such as a styrene foam. Alternatively, the wicks can be made from a loosely woven material that is rolled or folded to form the wick. In either case, it is important that the fluid be able to flow through the open cells of the foam or loosely woven material. As this occurs, the velocity of the fluid is reduced and the turbulent flow of fluid resulting from fluid flowing through the chute without a wick is converted to laminar flow at the time the fluid enters the sump tank. Thus, there is no air entrapment and the chemistry of the fluid is not degraded. Preferably, the wick is made of a flexible material that can be configured to any desired shape.

Preferably, the wicks 92, 94 extend far enough downwardly to be below the surface 96 of fluid in the sump tank 20. Thus, as illustrated in FIG. 3, both the chutes 88, 90 and the wicks 92, 94 are below the level of the surface 96. Surface 96 can be maintained at a constant level by providing an overflow hole 98 in a wall of the sump tank through which excess fluid can be removed from the tank and provided to a storage container or a drain (not shown).

While the wicks are specifically shown in the chutes used for returning fluid to the sump tank, similar wicks can be used in other areas of the processor where fluid traveling along its path encounters a free-fall resulting in turbulence and air entrapment that is detrimental to the chemistry of the fluid. For example, part of the path for fluid flows from the upper tank 38 to the lower tank 40 through a series of connecting tubes 44, and the fluid may be subject to free-fall as it moves through those tubes. Therefore, wicks can also be provided in the tubes to convert the free-fall turbulent flow of the fluid to a laminar flow and avoid air entrapment.

The invention has been described in detail with particular reference to preferred embodiments thereof, but it will be understood that variations and modifications can be effected within the spirit and scope of the invention.

We claim:

1. In a processor for processing latent images on a photosensitive material, the processor having a processing chamber through which the material can be advanced for processing the material, a sump for holding a supply of processing fluid, means for supplying processing fluid along a path extending from the sump to the chamber and back to the sump, at least one part of the path located so the processing fluid flows downwardly in the one part of the path, the improvement comprising:

a wick located along the one part of the path to avoid free-fall of the fluid in the one part of the path, and to produce laminar flow of the fluid, thereby reducing entrapment of air in the fluid, the wick being chemically inert to the fluid, and the wick having openings through which the fluid can flow as it travels through the one part of the path.

2. In a processor for processing latent images on a photosensitive material, the processor having a processing chamber through which the material can be advanced for processing the material, a sump for holding a supply of processing fluid, means for supplying processing fluid along a path extending from the sump to the chamber and then through a chute leading back to the sump, the chute extending vertically so the processing fluid flows downwardly through the chute, the improvement comprising:

a wick positioned in the chute, the wick comprising a flexible material that is chemically inert to the fluid, and the wick having openings through which the fluid can pass to produce laminar flow of the fluid and avoid air entrapment in the fluid, the wick extending downwardly into the sump and below the surface of fluid in the sump.

* * * * *